US011821288B2

(12) United States Patent
Hohl et al.

(10) Patent No.: US 11,821,288 B2
(45) Date of Patent: Nov. 21, 2023

(54) HYDRAULIC TOOLS, DRILLING SYSTEMS INCLUDING HYDRAULIC TOOLS, AND METHODS OF USING HYDRAULIC TOOLS

(71) Applicant: Baker Hughes Holdings LLC, Houston, TX (US)

(72) Inventors: Carsten Hohl, Sehnde (DE); Carsten Voss, Hannover (DE)

(73) Assignee: Baker Hughes Holdings LLC, Houston, TX (US)

( * ) Notice: Subject to any disclaimer, the term of this patent is extended or adjusted under 35 U.S.C. 154(b) by 0 days.

(21) Appl. No.: 17/648,386

(22) Filed: Jan. 19, 2022

(65) Prior Publication Data

US 2022/0145706 A1 May 12, 2022

Related U.S. Application Data

(62) Division of application No. 15/649,807, filed on Jul. 14, 2017, now Pat. No. 11,261,666, which is a (Continued)

(51) Int. Cl.
*E21B 4/02* (2006.01)

(52) U.S. Cl.
CPC ..... *E21B 4/02* (2013.01)

(58) Field of Classification Search
CPC ..... E21B 4/02; E21B 17/02; E21B 17/042; F04C 18/1075; F04C 2/1071; F04C 15/0076; F04C 2/1073; F04C 2/1075; F04C 9/007; F04C 2/104; F04C 2/105; F04C 2/103; F04C 2240/10; F04C 2240/20;
(Continued)

(56) References Cited

U.S. PATENT DOCUMENTS 3,084,631 A * 4/1963 Bourke ..... F04C 2/1075 418/48
3,499,389 A * 3/1970 Seeberger ..... F04C 2/1075 418/48

(Continued)

FOREIGN PATENT DOCUMENTS

WO 2012/122321 A2 9/2012
WO 2013/081804 A2 6/2013

OTHER PUBLICATIONS

International Preliminary Report on Patenlability for International Application No. PCT/US2014/063807, dated May 10, 2016, 5 pages.

(Continued)

*Primary Examiner* — Dariush Seif
(74) *Attorney, Agent, or Firm* — TraskBritt

(57) ABSTRACT

A hydraulic tool includes a rotor rotatably disposed within a stator. At least an inner portion of the stator and/or at least an outer portion of the rotor is configured to be installed in a drill string in either of two inverted orientations along a longitudinal axis of the hydraulic tool. The rotor is configured to rotate within the stator in either of the two orientations. A method includes disposing a rotor within a cavity defined by a stator, passing a fluid through the stator to rotate the rotor, and reversing the stator or the rotor. A drilling system includes a fluid source, a hydraulic tool, a drive shaft operatively associated with the rotor of the hydraulic tool, and a drill bit operatively associated with the drive shaft.

11 Claims, 6 Drawing Sheets

Related U.S. Application Data division of application No. 14/071,876, filed on Nov. 5, 2013, now abandoned.

(58) Field of Classification Search

CPC ..... F04C 2240/802; F04C 2225/00; F01C 1/101; F01C 19/02; F01C 19/08; F01C 19/10; F01C 9/007; F01C 1/104; F01C 1/103

USPC ..... 175/107; 418/48–53, 61.3, 152–156; 173/164

See application file for complete search history.

(56) References Cited

U.S. PATENT DOCUMENTS 3,912,426 A * 10/1975 Tschirky ..... F04C 2/1075 418/48
3,975,121 A * 8/1976 Tschirky ..... E21B 4/02 418/48
3,982,858 A * 9/1976 Tschirky ..... E21B 4/02 29/889.22
4,144,001 A * 3/1979 Streicher ..... F04C 2/1075 418/153
4,207,037 A * 6/1980 Riordan ..... E21B 4/003 138/140
4,271,915 A * 6/1981 Bodine ..... E21B 4/02 418/48
4,669,555 A * 6/1987 Petree ..... E21B 27/04 175/97
4,711,006 A * 12/1987 Baldenko ..... E21B 4/02 29/469
4,909,337 A * 3/1990 Kochnev ..... E21B 4/02 175/323
5,150,509 A * 9/1992 Wils ..... F16B 5/0241 29/897.3
5,171,138 A * 12/1992 Forrest ..... F01C 1/101 418/83
5,195,880 A * 3/1993 Gruber ..... F16D 1/101 418/5
5,620,056 A * 4/1997 Eppink ..... E21B 4/02 175/107
5,769,618 A * 6/1998 Ono ..... F16C 1/02 418/48
5,807,087 A * 9/1998 Brandt ..... F04C 2/1075 418/153
5,832,604 A * 11/1998 Johnson ..... F04C 2/1075 29/888.023
6,183,226 B1 * 2/2001 Wood ..... E21B 4/02 418/152
6,293,358 B1 * 9/2001 Jager ..... E21B 4/02 418/48
6,461,128 B2 * 10/2002 Wood ..... E21B 43/129 418/153
6,527,513 B1 * 3/2003 Van Drentham-Susman ..... E21B 4/02 415/903
6,543,132 B1 * 4/2003 Krueger ..... E21B 4/02 29/520
7,396,220 B2 * 7/2008 Delpassand ..... F04C 13/008 418/153
8,109,746 B2 * 2/2012 Guidry, Jr. ..... E21B 4/02 418/48
8,613,608 B2 * 12/2013 Ree ..... F04C 2/1071 418/160
8,985,977 B2 * 3/2015 Hohl ..... F04C 13/008 418/152
9,112,398 B2 * 8/2015 Taylor ..... F04C 2/1075
2001/0005486 A1 * 6/2001 Wood ..... F03C 2/08 418/152
2002/0074167 A1 * 6/2002 Plop ..... E21B 4/02 175/107
2002/0148645 A1 10/2002 Falgout
2003/0192184 A1 10/2003 Hache
2004/0119607 A1 * 6/2004 Davies ..... G01V 11/002 340/854.4
2004/0258548 A1 * 12/2004 Zitka ..... F04C 2/1075 418/153
2006/0131079 A1 * 6/2006 Bottos ..... F04C 2/1075 175/107
2006/0216178 A1 * 9/2006 Sindt ..... E21B 4/02 418/45
2008/0000083 A1 * 1/2008 Wood ..... E21B 4/02 29/889.22
2009/0016893 A1 * 1/2009 Lee ..... F04C 2/1075 416/241 R
2009/0095528 A1 * 4/2009 Hay ..... F04C 14/06 175/26
2009/0136371 A1 * 5/2009 Gerling ..... F04C 15/0073 418/48
2009/0169364 A1 * 7/2009 Downton ..... F04C 2/1075 29/888.023
2010/0006342 A1 * 1/2010 Froehlich ..... E21B 4/02 175/107
2010/0038142 A1 * 2/2010 Snyder ..... E21B 4/02 175/57
2010/0239446 A1 * 9/2010 Ree ..... F04C 15/0057 418/48
2010/0316518 A1 * 12/2010 Guidry, Jr. ..... E21B 4/02 418/48
2010/0329913 A1 * 12/2010 Ree ..... F04C 13/00 418/48
2011/0116959 A1 * 5/2011 Akbari ..... B29C 70/745 418/48
2011/0129375 A1 6/2011 Kotsonis
2011/0150686 A1 * 6/2011 Trushin ..... F04C 13/008 418/48
2012/0018227 A1 * 1/2012 Puzz ..... F04C 2/1075 51/297
2012/0118646 A1 5/2012 Russell et al.
2012/0148432 A1 * 6/2012 Butuc ..... F04C 2/1075 29/888.023
2012/0181042 A1 * 7/2012 Ahmed ..... E21B 43/126 418/48
2012/0273282 A1 * 11/2012 Lin ..... E21B 43/128 427/372.2
2013/0000986 A1 * 1/2013 Dick ..... E21B 4/02 29/888.025
2013/0014995 A1 * 1/2013 Scott ..... C22C 26/00 175/107
2013/0020132 A1 * 1/2013 John ..... F04C 15/0088 175/57
2013/0048384 A1 * 2/2013 Jarvis ..... F04C 2/1071 175/57
2013/0052067 A1 * 2/2013 Hohl ..... E21B 4/02 29/888.023
2013/0064702 A1 * 3/2013 Hohl ..... F03C 2/08 29/888.023
2013/0118247 A1 * 5/2013 Akbari ..... F04C 2/1075 156/244.11
2013/0133950 A1 * 5/2013 Hohl ..... F04C 2/1075 175/57
2013/0149182 A1 * 6/2013 Sreshta ..... F04C 2/1075 418/220
2013/0175093 A1 * 7/2013 Taylor ..... E21B 4/02 175/57
2014/0054091 A1 * 2/2014 Barnard ..... F04C 2/1073 175/107
2014/0119974 A1 * 5/2014 Kitching ..... F04C 2/082 418/191
2014/0134029 A1 * 5/2014 Coghlan, III ..... F04C 2/1075 29/888.023
2014/0158426 A1 * 6/2014 Hay ..... F04C 2/1071 418/16
2014/0170011 A1 * 6/2014 Clouzeau ..... E21B 43/121 418/201.1
2014/0196905 A1 * 7/2014 Schultz ..... E21B 7/24 166/319

(56) References Cited

U.S. PATENT DOCUMENTS

2014/0262524 A1* 9/2014 Valliyappan ..... F03B 13/02 175/57
2014/0332275 A1* 11/2014 Murray ..... F01C 1/10 175/57
2015/0022051 A1* 1/2015 Meng ..... B29C 45/0001 524/514
2015/0122549 A1* 5/2015 Hohl ..... E21B 4/02 175/57
2015/0218885 A1* 8/2015 Sitka ..... E21B 4/003 175/57
2015/0233373 A1* 8/2015 Sicilian ..... C08K 9/04 29/888.023
2015/0267492 A1* 9/2015 Broussard, Jr. ..... E21B 10/04 175/107
2015/0354280 A1* 12/2015 Downton ..... F03B 13/02 175/107
2016/0036284 A1* 2/2016 Meng ..... E21B 4/02 524/404
2016/0040480 A1* 2/2016 Evans ..... F04C 13/008 29/888.023
2017/0306700 A1* 10/2017 Hohl ..... E21B 4/02

OTHER PUBLICATIONS

International Search Report for International Application No. PCT/US2014/063807, dated Feb. 12, 2015, 3 pages.
International Written Opinion for International Application No. PCT/US2014/063807, dated Feb. 12, 2015, 1 pages.
Schweitzer et al., Touch-Down Bearings, Magnetic Bearings, (2009), pp. 389-406.
Wang et al., Study on Solid Molding and Reverse Meted for the Inner Helicoids of Helical Stator, Communications nd Networks (CECNe), 2011 International Conference on Consumer Electronics, Apr. 16-18, 2011, pp. 4457-4460.

* cited by examiner

HYDRAULIC TOOLS, DRILLING SYSTEMS INCLUDING HYDRAULIC TOOLS, AND METHODS OF USING HYDRAULIC TOOLS

CROSS-REFERENCE TO RELATED APPLICATIONS

This application is a divisional of U.S. patent application Ser. No. 15/649,807, filed Jul. 14, 2017, now U.S. Pat. No. 11,261,666, issued Mar. 1, 2022, which is a divisional of U.S. patent application Ser. No. 14/071,876, filed Nov. 5, 2013, the disclosure of each of which is hereby incorporated herein in its entirety by this reference.

FIELD

Embodiments of the present disclosure relate generally to hydraulic tools, such as drilling motors and pumps, to drilling systems that include hydraulic tools, and to methods of forming and using such tools and systems.

BACKGROUND

To obtain hydrocarbons such as oil and gas from subterranean formations, wellbores are drilled into the formations by rotating a drill bit attached to an end of a drill string. A substantial portion of current drilling activity involves what is referred to in the art as "directional" drilling. Directional drilling involves drilling deviated and/or horizontal wellbores (as opposed to straight, vertical wellbores). Modern directional drilling systems generally employ a bottom hole assembly (BHA) at the end of the drill string that includes a drill bit and a hydraulically actuated motor to drive rotation of the drill bit. The drill bit is coupled to a drive shaft of the motor, typically through an assembly configured for steering the path of the drill bit, and drilling fluid pumped through the motor (and to the drill bit) from the surface drives rotation of the drive shaft to which the drill bit is attached. Such hydraulic motors are commonly referred to in the drilling industry as "mud motors," "drilling motors," and "Moineau motors." Such motors are referred to hereinafter as "hydraulic drilling motors."

Hydraulic drilling motors include a power section that contains a stator and a rotor disposed in the stator. The stator may include a metal housing that is lined inside with a helically contoured or lobed elastomeric material. The rotor is usually made from a suitable metal, such as steel, and has an outer lobed surface. Pressurized drilling fluid (commonly referred to as "drilling mud") is pumped into a progressive cavity formed between the rotor and the stator lobes. The force of the pressurized fluid pumped into and through the cavity causes the rotor to turn in a planetary-type motion. A suitable shaft connected to the rotor via a flexible coupling compensates for eccentric movement of the rotor. The shaft is coupled to a bearing assembly having a drive shaft (also referred to as a "drive sub"), which in turn rotates the drill bit through the aforementioned steering assembly.

As drilling fluid flows through the progressive cavity between the rotor and the stator, forces on the rotor and the stator, as well as abrasives in the drilling fluid, can damage parts of the motor. The motor may include a resilient portion (e.g., an elastomeric or rubber portion), typically as part of the stator, which is designed to wear. The elastomeric portion may be replaced after a certain amount of use, or when a selected amount of wear or damage is detected.

BRIEF SUMMARY

In some embodiments, a hydraulic tool includes a stator and a rotor rotatably disposed within the stator. At least one of at least an inner portion of the stator and at least an outer portion of the rotor is configured to be installed in a drill string in either of two inverted orientations along a longitudinal axis of the hydraulic tool. The rotor is configured to rotate within the stator in either of the two orientations of the stator.

In certain embodiments, a method of using a hydraulic tool includes disposing a rotor within a cavity defined by a stator. The stator has a plurality of lobes having a first end disposed proximate an upper end of the hydraulic tool and a second end longitudinally opposite the first end disposed proximate a lower end of the hydraulic tool. The rotor has at least one lobe having a first end and a second end longitudinally opposite the first end. The first end of the at least one lobe of the rotor is disposed proximate the upper end of the hydraulic tool, and the second end of the at least one lobe of the rotor is disposed proximate the lower end of the hydraulic tool. The methods further include passing a fluid through the cavity defined by the stator to rotate the rotor and at least one of removing the rotor from the cavity defined by the stator and removing the stator from the hydraulic tool. The methods include at least one of disposing the rotor into the cavity defined by the stator such that the first end of the rotor is disposed proximate the lower end of the hydraulic tool and the second end of the rotor is disposed proximate the upper end of the hydraulic tool and securing the stator to the hydraulic tool such that the first end of the stator is proximate the lower end of the hydraulic tool and the second end of the stator is proximate the upper end of the hydraulic tool.

In some embodiments, a drilling system includes a fluid source, a hydraulic tool, a drive shaft operatively associated with the rotor of the hydraulic tool, and a drill bit operatively associated with the drive shaft. The hydraulic drilling motor includes a stator and a rotor rotatably disposed within the stator. At least one of at least an inner portion of the stator and at least an outer portion of the rotor is configured to be installed in a drill string in either of two inverted orientations along a longitudinal axis of the hydraulic tool. The rotor is configured to rotate within the stator in either of the two orientations of the stator when fluid is provided to the hydraulic tool from the fluid source.

BRIEF DESCRIPTION OF THE DRAWINGS

While the specification concludes with claims particularly pointing out and distinctly claiming what are regarded as embodiments of the present disclosure, various features and advantages of embodiments of the disclosure may be more readily ascertained from the following description of example embodiments of the disclosure when read in conjunction with the accompanying drawings, in which:

DETAILED DESCRIPTION

The illustrations presented herein are not actual views of any particular hydraulic tool, rotor, stator, hydraulic drilling motor, hydraulic pump, or drilling system, but are merely idealized representations that are employed to describe example embodiments of the present disclosure. Additionally, elements common between figures may retain the same numerical designation.

The present disclosure includes hydraulic tools (e.g., drilling motors, progressive cavity pumps, etc.) each having a stator and a rotor. At least a portion of the stator and/or the rotor is configured to be used in either of two orientations. The stator or rotor may be inverted, which may also be characterized as directionally reversed, after a first use to move fatigued or stressed portions of the stator or rotor to positions in which lower stresses are expected to be encountered and to move less-fatigued portions of the stator or rotor to higher-stress positions. Thus, the motor may have a longer useful life than a conventional motor having a stator and rotor each configured to be used in a single orientation.

Figure 1A:
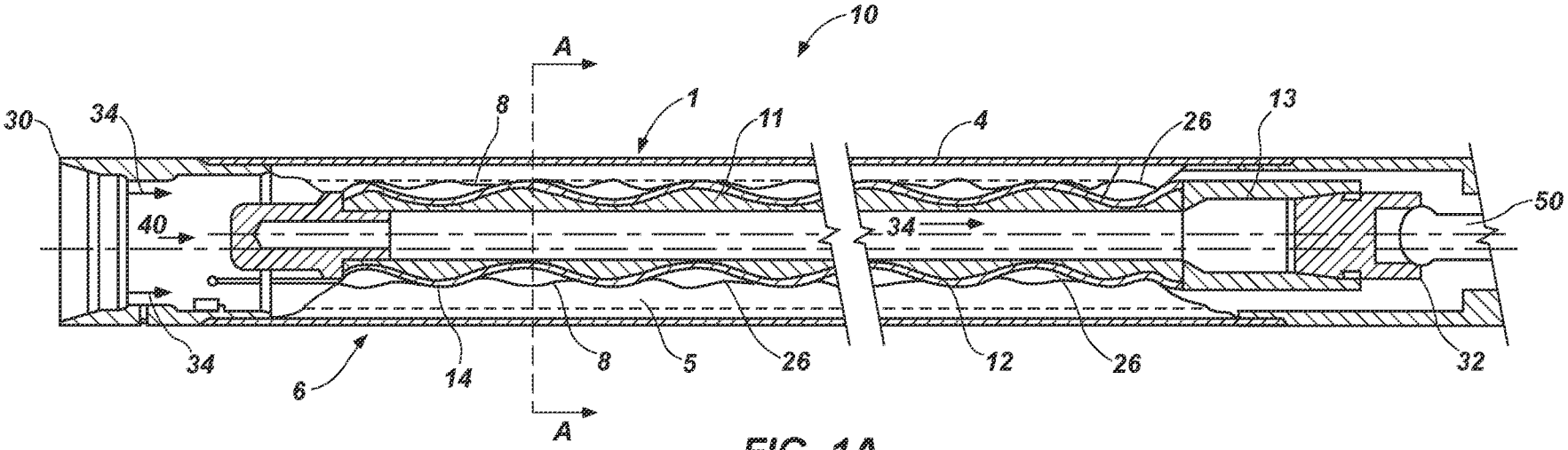
FIGS. 1A and 1B are simplified cross-sectional side views illustrating an embodiment of a hydraulic tool according to the present disclosure.
Figure 1B:
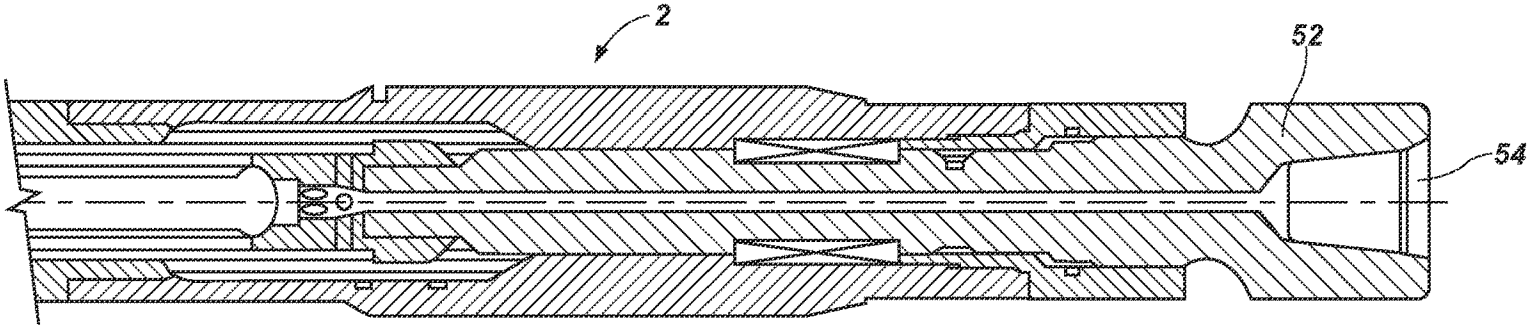

Referring to FIGS. 1A and 1B, a hydraulic drilling motor 10 includes a power section 1 and a bearing assembly 2. The power section 1 includes an elongated metal housing 4, having a resilient material 5 therein that has a helically lobed inner surface 8. The resilient material 5 is secured inside the metal housing 4, for example, by adhesively bonding the resilient material 5 within the interior of the metal housing 4. The resilient material 5 is a material that is able to return to its original shape after being pulled, stretched, or pressed. The resilient material 5 may include, for example, a polymer such as a fluorosilicone rubber (FVMQ, e.g., a copolymer of fluorovinyl and methyl siloxane), nitrile butadiene rubber (NBR), a fluoroelastomer (FKM, e.g., a fluorocarbon copolymer, terpolymer, pentamer, etc.), hydrogenated nitrile butadiene rubber (HNBR), fluorinated ethylene propylene (FEP), vinyl methyl polysiloxane (VMQ), carboxylated nitrile butadiene rubber (XNBR), polyacrylate acrylic rubber (ACM), a perfluoroelastomer (FFKM), ethylene propylene rubber (EPM), ethylene propylene diene monomer rubber (EPDM), or acrylic ethylene copolymer (AEM). The resilient material 5 and the metal housing 4 together form a stator 6, which may be configured to be reversible along a longitudinal axis thereof. In other words, the hydraulic drilling motor 10 may be operable with at least a portion of the stator 6 in either of two longitudinally inverted orientations (i.e., two orientations longitudinally inverted from one another).

A rotor 11 is rotatably disposed within the stator 6 and configured to rotate therein responsive to the flow of drilling fluid (e.g., a liquid or a suspension of solid particulate matter in a liquid) through the hydraulic drilling motor 10. The rotor 11 may include an elongated metal core 13 having a resilient material 14 thereon that has a helically lobed outer surface 12 configured to engage with the helically lobed inner surface 8 of the stator 6. The resilient material 14 may be secured over the metal core 13, for example, by adhesively bonding the resilient material 14 over the exterior of the metal core 13. The resilient material 14 may be the same material as the resilient material 5 of the stator 6, or the resilient materials 5, 14 may be different materials. In some embodiments, a hardfacing material may be formed on a portion of the outer surface 12 of the rotor 11. For example, the hardfacing material may include chrome, nickel, cobalt, tungsten carbide, diamond, diamond-like-carbon, boron carbide, cubic boron nitride, nitrides, carbides, oxides, borides and alloys hardened by nitriding, boriding, carbonizing or any combination of these materials. Hardfacing may be applied pure or as a composite in a binder matrix. Hardfacing materials on rotors are described in U.S. Patent Application Publication No. 2012/0018227, published Jan. 26, 2012, and titled "Components and motors for downhole tools and methods of applying hardfacing to surfaces thereof," the entire disclosure of which is hereby incorporated by reference. In some embodiments, hardfacing materials may be disposed on surfaces of the stator 6.

The rotor 11 may be configured to be reversible along a longitudinal axis thereof. In other words, the hydraulic drilling motor 10 may be operable with at least a portion of the rotor 11 in either of two longitudinally inverted orientations (i.e., two orientations longitudinally inverted from one another). The inversion of the rotor 11 may be independent of the inversion of the stator 6. That is, the rotor 11, the stator 6, or both may be inverted.

The outer surface 12 of the rotor 11 and the inner surface 8 of the stator 6 may have similar, but slightly different profiles. For example, the outer surface 12 of the rotor 11 may have one fewer lobe than the inner surface 8 of the stator 6. The outer surface 12 of the rotor 11 and the inner surface 8 of the stator 6 may be configured so that seals are established directly between the rotor 11 and the stator 6 at discrete intervals along and circumferentially around the interface therebetween, resulting in the creation of fluid chambers or cavities 26 between the outer surface 12 of the rotor 11 and the inner surface 8 of the stator 6. The cavities 26 may be filled with a pressurized drilling fluid 40.

As the pressurized drilling fluid 40 flows from a top 30 to a bottom 32 of the power section 1, as shown by flow arrow 34, the pressurized drilling fluid 40 causes the rotor 11 to rotate within the stator 6. The number of lobes and the geometries of the outer surface 12 of the rotor 11 and inner surface 8 of the stator 6 may be modified to achieve desired input and output requirements and to accommodate different drilling operations. The rotor 11 may be coupled to a flexible shaft 50, and the flexible shaft 50 may be connected to a drive shaft 52 in the bearing assembly 2. As previously mentioned, a drill bit may be attached to the drive shaft 52. For example, the drive shaft 52 may include a threaded box 54, and a drill bit may be provided with a threaded pin that may be engaged with the threaded box 54 of the drive shaft 52.

Figure 2A:
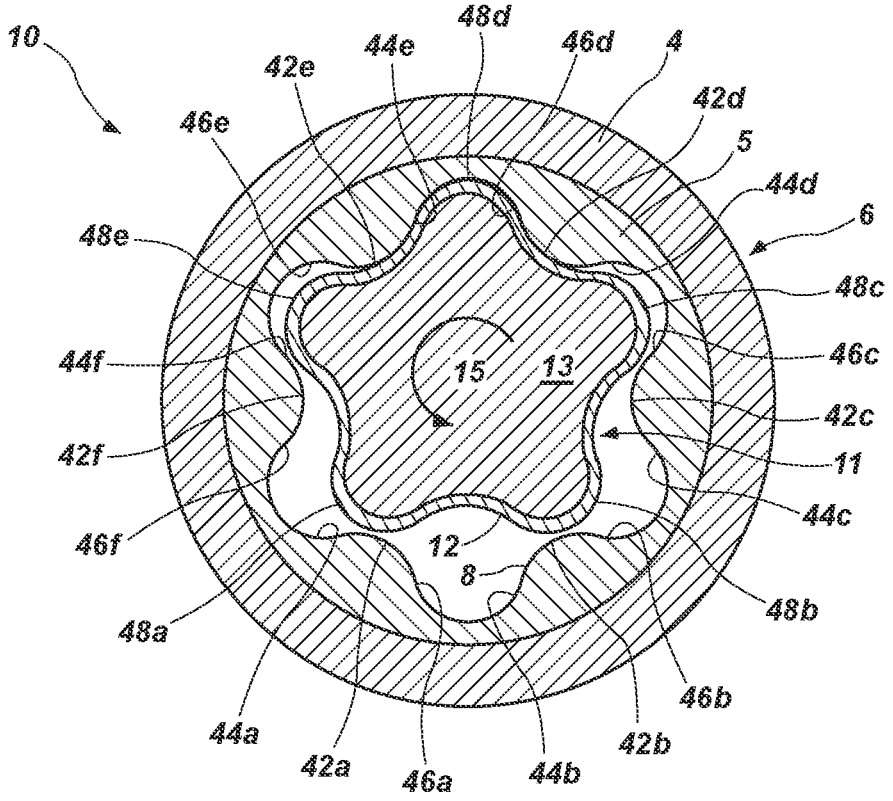
FIG. 2A is a simplified transverse cross-sectional view of a portion of the hydraulic tool shown in FIGS. 1A and 1B taken along section line A-A therein.
Figure 2B:
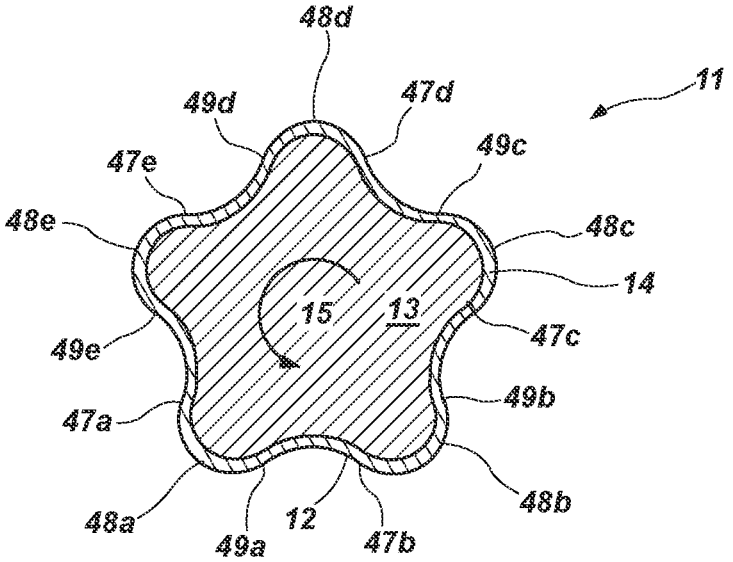
FIG. 2B is a simplified transverse cross-sectional view of the rotor 11 of the hydraulic tool taken at section line A-A of FIG. 1A.

FIG. 2A is a cross-sectional view of the stator 6 and the rotor 11 of the hydraulic drilling motor 10 taken at section A-A of FIG. 1A. FIG. 2B is a cross-sectional view of the rotor 11 of the hydraulic drilling motor 10 taken at section line A-A of FIG. 1A. As shown in FIG. 2A, the inner surface 8 of the metal housing 4 and the outer surface 12 of the resilient material 5 may each be approximately cylindrical or tubular. The inner surface 8 of the stator 6 shown in FIG. 2A includes lobes 42*a*-42*f*, which may be configured to interface with lobes 48*a*-48*e* of the rotor 11. As the rotor 11 rotates in the direction indicated by arrow 15, the lobes 48*a*-48*e* of the rotor 11 move into and out of the spaces between the lobes 42*a*-42*f* of the stator 6. As the rotor 11 rotates, portions of the stator 6 and/or the rotor 11 experience stresses. If the stator 6 includes a resilient material 5, the resilient material 5 may be designed to partially deform as the rotor 11 rotates. Similarly, if the rotor 11 includes a resilient material 14, the resilient material 14 may be designed to partially deform as the rotor 11 rotates. Thus, the resilient materials 5, 14 may sustain a finite amount of damage (e.g., fatigue) for each rotation of the rotor 11. Any damage to the resilient materials 5, 14 may be concentrated at portions of the resilient materials 5, 14 subjected to highest loads, which damage may be aggravated by solids in the drilling fluid. For example, when the rotor 11 rotates in the direction indicated by arrow 15, forces on the resilient material 5 may be concentrated on surfaces 44*a*-44*f* of the lobes 42*a*-42*f*. The surfaces 46*a*-46*f* on opposite sides of the lobes 42*a*-42*f* from the surfaces 44*a*-44*f* may be exposed to relatively lower stress. Thus, the portions of the lobes 42*a*-42*f* nearest the surfaces 44*a*-44*f* may sustain more damage than the portions of the lobes 42*a*-42*f* nearest the surfaces 46*a*-46*f*.

Furthermore, when the rotor 11 rotates in the direction indicated by arrow 15, forces on the resilient material 14 may be concentrated on surfaces 49*a*-49*e* (FIG. 2B) of the lobes 48*a*-48*e*. The surfaces 47*a*-47*e* on opposite sides of the lobes 48*a*-48*e* from the surfaces 49*a*-49*e* may be exposed to relatively lower stress. Thus, the portions of the lobes 48*a*-48*e* nearest the surfaces 49*a*-49*e* may sustain more damage than the portions of the lobes 48*a*-48*e* nearest the surfaces 47*a*-47*e*.

Figure 3:
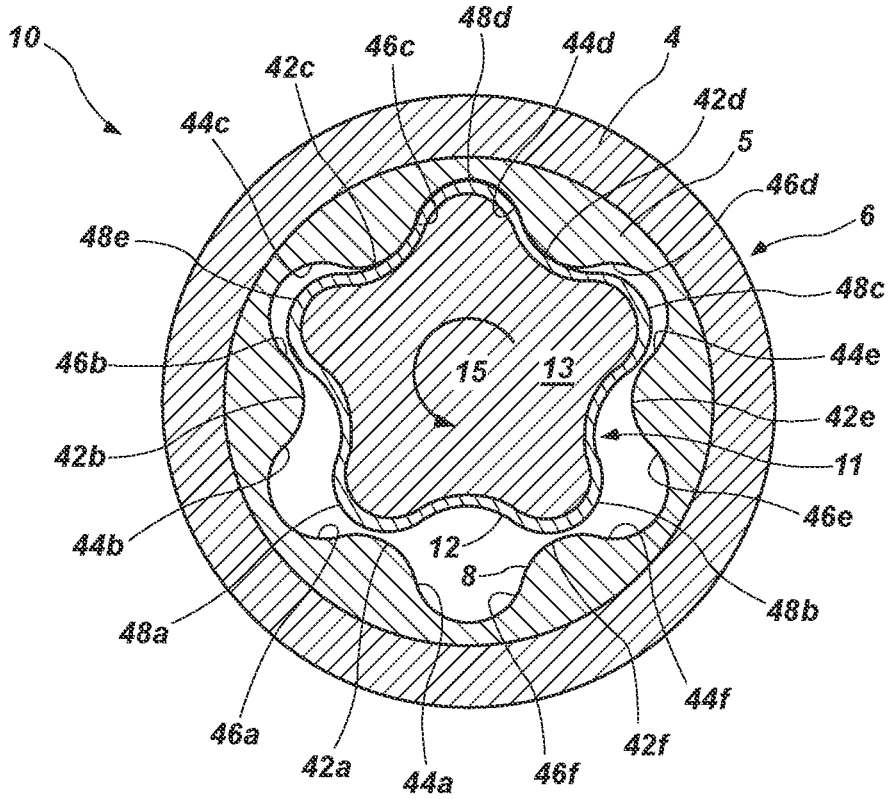
FIG. 3 is a simplified transverse cross-sectional view of a portion of the hydraulic tool shown in FIGS. 1A and 1B after the stator has been reversed.

After the hydraulic drilling motor 10 has been used in a drilling operation, the stator 6 may be reversed (e.g., inverted by flipping end-to-end). For example, FIG. 3 is a cross-sectional view of the stator 6 of the hydraulic drilling motor 10 taken at section line A-A of FIG. 1A after the stator 6 has been reversed from the orientation shown in FIG. 2A. As the rotor 11 rotates in the direction indicated by arrow 15 (which is the same rotational direction indicated in FIG. 2A), the lobes 48*a*-48*e* of the rotor 11 move into and out of the spaces between the lobes 42*a*-42*f* of the stator 6 in the opposite order from the order corresponding to the orientation shown in FIG. 2A. Thus, as the rotor 11 rotates, different portions of the stator 6 experience relatively higher stresses in comparison to the portions of stator 6 experiencing relatively higher stresses in the orientation shown in FIG. 2A. For example, when the rotor 11 rotates in the direction indicated by arrow 15, forces on the resilient material 5 may be concentrated on the surfaces 46*a*-46*f* of the lobes 42*a*-42*f* The surfaces 44*a*-44*f* on the opposite sides of the lobes 42*a*-42*f* from the surfaces 46*a*-46*f* may be exposed to relatively lower stresses in this configuration. Thus, the portions of the lobes 42*a*-42*f* nearest the surfaces 46*a*-46*f* may sustain more damage than the portions of the lobes 42*a*-42*f* nearest the surfaces 44*a*-44*f* Before the stator 6 has been used, the lobes 42*a*-42*f* may be symmetric, such that when the stator 6 is inverted, the lobes 42*a*-42*f* of the stator 6 engage with the lobes 48*a*-48*e* of the rotor 11 in the same manner as in the original non-inverted orientation. Thus, before the stator 6 has been subjected to wear, each of the surfaces 44*a*-44*f* and the surfaces 46*a*-46*f* may have identical profiles.

Figure 4:
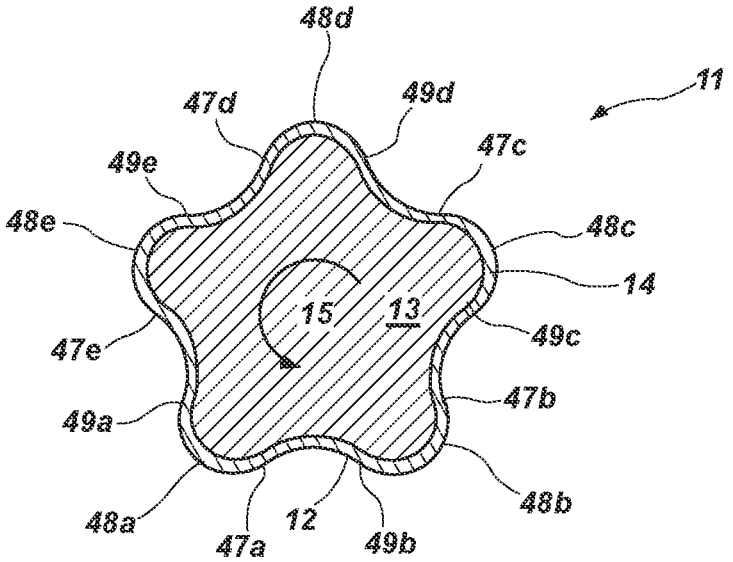
FIG. 4 a simplified transverse cross-sectional view of the rotor 11 of the hydraulic tool shown in FIGS. 1A and 1B after the rotor has been reversed.

After the hydraulic drilling motor 10 has been used in a drilling operation, the rotor 11 may be reversed (e.g., inverted by flipping end-to-end). FIG. 4 is a cross-sectional view of the rotor 11 of the hydraulic drilling motor 10 taken at section line A-A of FIG. 1A after the rotor 11 has been reversed from the orientation shown in FIG. 2B. The reversal may be independent of the reversal of the stator 6 depicted by the orientation shown in FIG. 3. When the rotor 11 rotates in the direction indicated by arrow 15, forces on the resilient material 14 may be concentrated on surfaces 47*a*-47*e* of the lobes 48*a*-48*e*. The surfaces 49*a*-49*e* on opposite sides of the lobes 48*a*-48*e* from the surfaces 47*a*-47*e* may be exposed to relatively lower stress. Thus, the portions of the lobes 48*a*-48*e* nearest the surfaces 47*a*-47*e* may sustain more damage than the portions of the lobes 48*a*-48*e* nearest the surfaces 49*a*-49*e*. Before the rotor 11 has been used, the lobes 48*a*-48*e* may be symmetric, such that when the rotor 11 is inverted, the lobes 48*a*-48*e* of the stator 6 engage with the lobes 42*a*-42*f* of the stator 6 in the same manner as in the original non-inverted orientation. Thus, before the rotor 11 has been subjected to wear, each of the surfaces 47*a*-47*e* and the surfaces 49*a*-49*e* may have identical profiles. To enable reversal of the rotor 11, the rotor 11 may have identical fittings at both ends. In some embodiments, one or more adapters may be used to connect the rotor 11 to other parts of the hydraulic drilling motor 10.

In a drilling operation in which the orientation of the stator 6 and/or the rotor 11 has been reversed, the more-worn or more-damaged portions of the resilient materials 5, 14 may be placed in positions where they are likely to be exposed to relatively lower stress, and the less-worn or less-damaged portions of the resilient materials 5, 14 may be placed in positions where they are likely to be exposed to relatively higher stress. The stator 6 and/or the rotor 11 may exhibit a longer useful life, and the stator 6 and/or the rotor 11 may wear more evenly than conventional stators and rotors. In some embodiments, the stator 6 and/or the rotor 11 may exhibit approximately the same useful life in its second (reversed) orientation as in its first orientation. In such embodiments, the total life of the stator 6 and/or the rotor 11 may be approximately double the life of a conventional stator or rotor having similar materials and dimensions.

Figure 5:
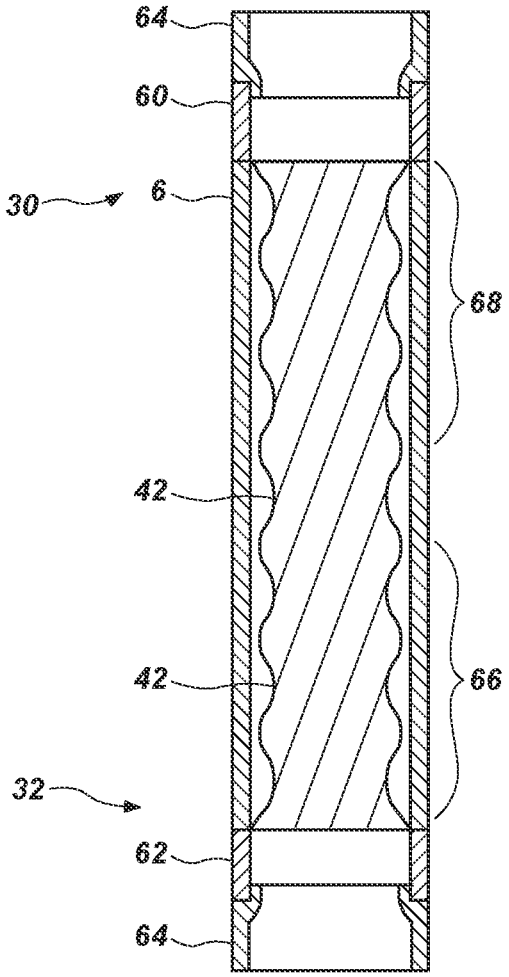
FIG. 5 is an additional simplified cross-sectional side view of the stator of the hydraulic tool shown in FIGS. 1A and 1B, and including adapters to connect the stator to other components.

FIG. 5 is another cross-sectional view illustrating the stator 6 of the hydraulic drilling motor 10. The stator 6 may include a first fitting 60 at one end of the stator 6 and a second fitting 62 at the opposite end of the stator 6. The first fitting 60 and the second fitting 62 may have identical threads (e.g., the same pitch, thread density, and thread profile, both male or both female, etc.), such that either the first fitting 60 or the second fitting 62 may be attached to top 30 or the bottom 32 of the power section 1 of the hydraulic drilling motor 10 (see FIG. 1A). In some embodiments, the first fitting 60 and/or the second fitting 62 may include one or more adapters 64 to connect the stator 6 to the top 30 or the bottom 32 of the power section 1. In such embodiments, the first fitting 60 and the second fitting 62 need not have identical threads, although they may have identical threads, but the adapter(s) 64 may include appropriate threads to allow attachment to the top 30 or the bottom 32 of the power section 1. For example, and not by way of limitation, the adapter(s) 64 may, respectively, include an industry-standard box connection or pin connection.

Lobes 42 near the bottom 32 of the power section 1 are likely to be exposed to more stress than lobes 42 near the top 30 of the power section 1. Thus, after use in a drilling operation, the stator 6 may include a more-worn region 66 near the lower end of the stator 6 and a less-worn region 68 near the upper end of the stator 6.

Figure 6:
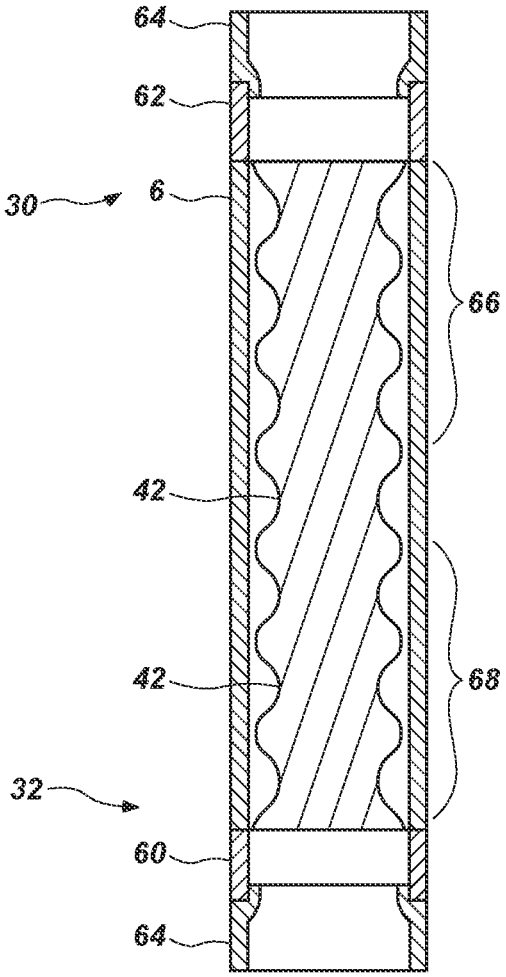
FIG. 6 is a simplified cross-sectional side view of the stator shown in FIG. 4 after the stator has been reversed.

In a subsequent drilling operation, the stator 6 may be reversed, such that the first fitting 60 is connected to the bottom 32 of the power section 1, and the second fitting 62 is connected to the top 30 of the power section 1. In this orientation, as shown in FIG. 6, the more-worn region 66 is near the upper end of the stator 6 and a less-worn region 68 is near the lower end of the stator 6. The less-worn region 68 may be exposed to relatively more stress than the more-worn region 66 when the stator 6 is operated in this orientation. After the subsequent drilling operation, both regions 66, 68 may have similar amounts of wear or damage.

In some embodiments, the stator 6 and/or the rotor 11 may be free of the resilient materials 5, 14. If both the stator 6 and the rotor are free of the resilient materials 5, 14, the hydraulic drilling motor 10 may be referred to as a "metal-to-metal motor" because metal of the stator 6 contacts metal of the rotor 11 when the hydraulic drilling motor 10 is in operation. Metal-to-metal motors may be beneficial in some applications, such as when the hydraulic drilling motor 10 operates at temperatures above which the resilient materials 5, 14 are stable. The stators 6 and rotors 11 disclosed herein may be used in metal-to-metal motors to increase the useful life of such motors.

Figure 7:
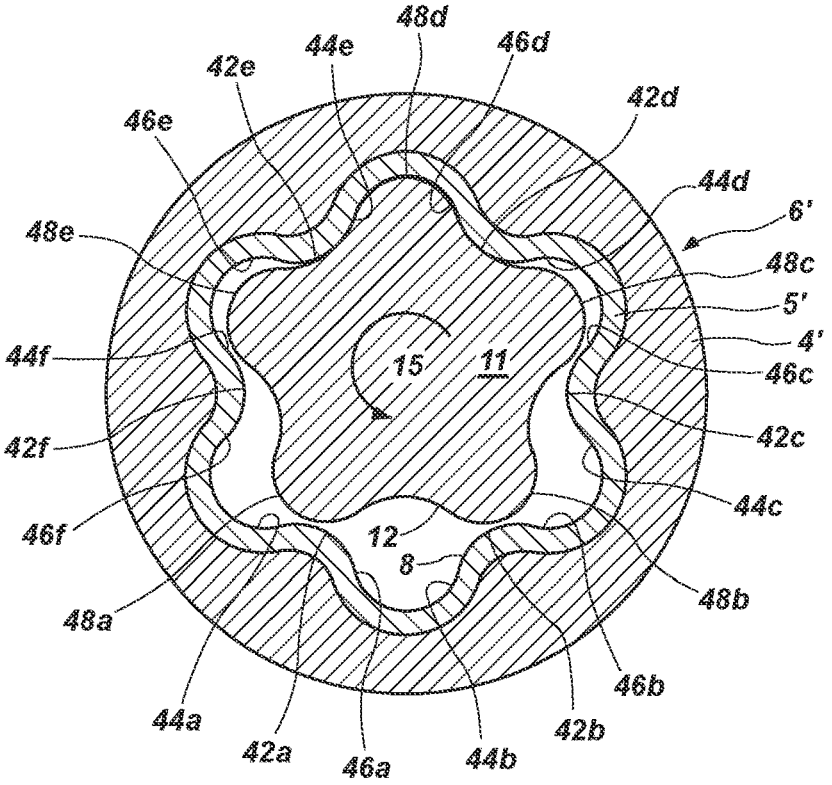
FIG. 7 is a simplified transverse cross-sectional view of a portion of a hydraulic tool having a pre-contoured stator.

FIG. 7 illustrates a cross-sectional view of another stator 6'. The stator 6' includes a metal housing 4' and a resilient material 5'. As shown in FIG. 7, the inner surface of the metal housing 4 and the outer surface 12 of the resilient material 5 may each be shaped to approximately correspond to the shape of the inner surface 8 of the stator 6', which may be the same shape as the inner surface 8 of the stator 6 shown in FIG. 2A. That is, the thickness of the resilient material 5' may be approximately uniform, and the shape of the inner surface 8 may be based on the shape of the inner surface of the metal housing 4'. The stator 6' may be referred to as "pre-contoured" because the shape of the inner surface 8 of the stator 6' is defined before application of the resilient material 5'. The stator 6' may be used in either direction in a hydraulic drilling motor 10 (FIG. 1A), as described above with respect to the stator 6 in reference to FIGS. 2A and 3. That is, when the rotor 11 rotates in the direction indicated by arrow 15, forces on the resilient material 5' may be concentrated on surfaces 44*a*-44*f* of the lobes 42*a*-42*f* The surfaces 46*a*-46*f* opposite the surfaces 44*a*-44*f* may be exposed to relatively little stress. Thus, the portions of the lobes 42*a*-42*f* nearest the surfaces 44*a*-44*f* may sustain more damage than the portions of the lobes 42*a*-42*f* nearest the surfaces 46*a*-46*f* Depending on the properties of the resilient material 5' and the thickness thereof, the portions of the lobes 42*a*-42*f* nearest the surfaces 46*a*-46*f* may sustain little to no significant damage when the stator 6' is used in the orientation of FIG. 7.

After the hydraulic drilling motor 10 has been used in a drilling operation, the stator 6' may be reversed (e.g., inverted by flipping end-to-end). As the rotor 11 rotates, different portions of the stator 6' experience relatively higher stresses from the portions experiencing relatively higher stresses in the orientation shown in FIG. 7. For example, forces on the resilient material 5' may be concentrated on surfaces 46*a*-46*f* of the lobes 42*a*-42*f* The surfaces 44*a*-44*f* opposite the surfaces 46*a*-46*f* may be exposed to relatively lower stress at this time. Thus, the portions of the lobes 42*a*-42*f* nearest the surfaces 46*a*-46*f* may sustain more damage than the portions of the lobes 42*a*-42*f* nearest the surfaces 44*a*-44*f* After similar use in both orientations (e.g., similar time and loading conditions), the wear on the resilient material 5' may be approximately the same near the surfaces 44*a*-44*f* and the surfaces 46*a*-46*f* Reversal of the stator 6' may enable the stator 6' to have a longer useful life. The stator 6', when configured as described, may have lower risk of failure in service, such as by cracking and separation of the resilient material 5' while the stator 6' is downhole. Thus, the stator 6' may be reversibly used to limit non-productive time and tool damage.

Figure 8:
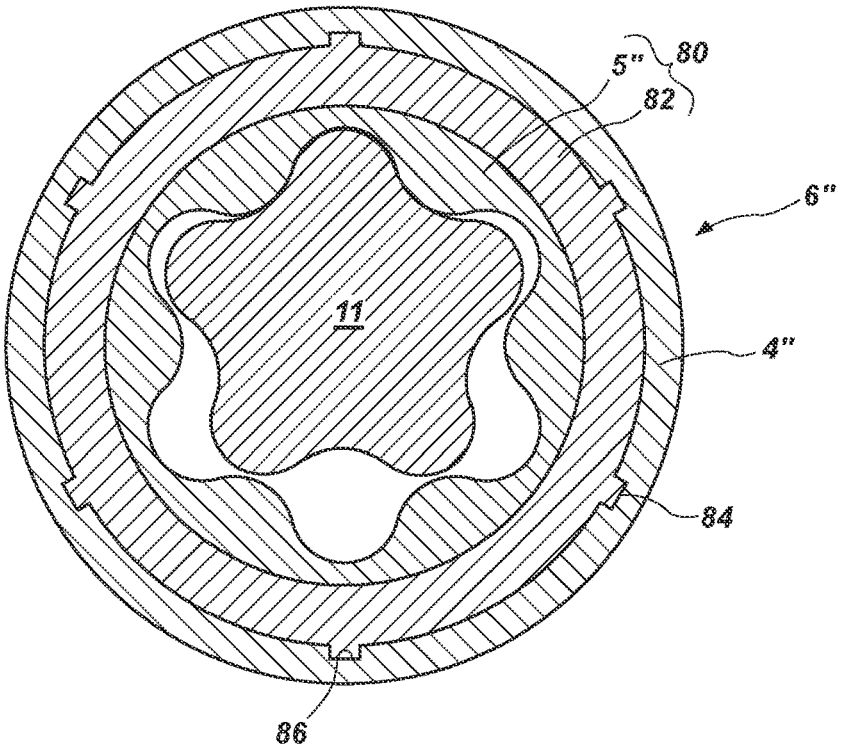
FIG. 8 is a simplified cross-sectional view of a stator having a reversible cartridge, according to the present disclosure.

FIG. 8 illustrates a cross-sectional view of another stator 6". The stator 6" includes a metal housing 4" and a cartridge 80. The cartridge 80 includes a metal shell 82 and a resilient material 5" secured to the metal shell 82. The resilient material 5" may be bonded to the metal shell 82 by physical or chemical means. For example, an adhesive may be disposed between the resilient material 5" and the metal shell 82. In some embodiments, the resilient material 5" may be structured and shaped such that the resilient material 5" stays in place within the metal shell 82.

The cartridge 80 may include a mechanism for attachment in the metal housing 4", such as one or more tabs 84. The tabs 84 may protrude from the metal shell 82, and, when the cartridge 80 is placed within the metal housing 4", may be disposed within one or more corresponding slots 86 in the metal housing 4". Thus, when the cartridge 80 is within the metal housing 4", rotation of the cartridge 80 within the metal housing 4" may be restricted by the interference of the tabs 84 with the metal housing 4".

The cartridge 80 may be removable from the metal housing 4" so that the cartridge 80 may be operated in either of two opposing orientations, as previously described herein. The cartridge 80 may be configured to slide into and out of the metal housing 4" when the stator 6" is at least partially disconnected from a drill string. For example, when the stator 6" is separated from a bearing assembly 2 (FIG. 1B), the cartridge 80 may slide out of the metal housing 4" around the rotor 11. The cartridge 80 may include pins or other fastening means to lock the cartridge 80 inside the metal housing 4".

A stator 6" having a cartridge 80 need not have the same connection hardware (e.g., threads, adapters, etc.) at both ends thereof because the cartridge 80 itself can be reversed within the metal housing 4". Thus, a stator 6" having a cartridge 80 may be fitted to existing drill strings with little modification, and without adapters.

Figure 9:
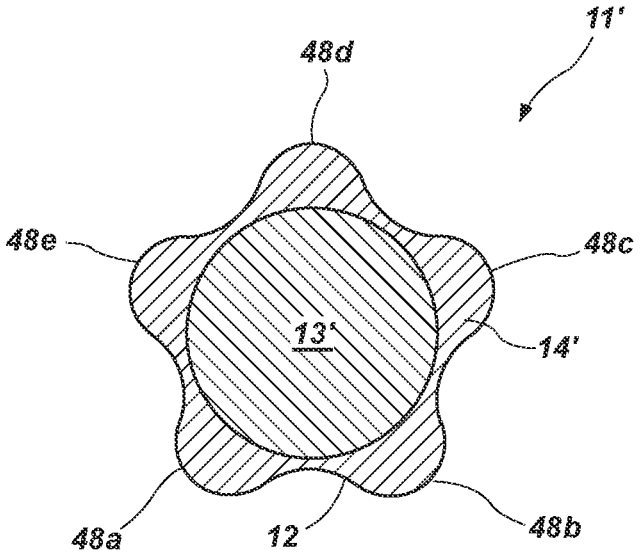
FIG. 9 is a simplified transverse cross-sectional view of a portion of a rotor having a core with a cylindrical cross section.

FIG. 9 illustrates a cross-sectional view of another rotor 11'. The rotor 11' includes a metal core 13' and a resilient material 14'. As shown in FIG. 9, the outer surface 12 of the metal core 13' may be circular, and the outer surface 12 of the resilient material 14' may have lobes 48*a*-48*e*. The thickness of the resilient material 14' may be nonuniform. The rotor 11' may be used in either direction in a hydraulic drilling motor 10 (FIG. 1A), as described above with respect to the rotor 11 in reference to FIGS. 2B and 4.

Figure 10:
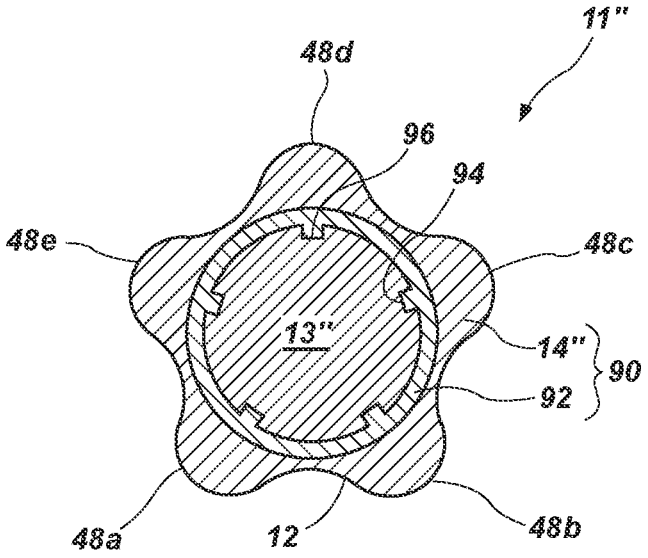
FIG. 10 is a simplified cross-sectional view of a rotor having a reversible cartridge, according to the present disclosure.

FIG. 10 illustrates a cross-sectional view of another rotor 11". The rotor 11" includes a metal core 13" and a cartridge 90 over the metal core 13". The cartridge 90 includes a metal shell 92 and a resilient material 14" secured to the metal shell 92. The resilient material 14" may be bonded to the metal shell 92 by physical or chemical means. For example, an adhesive may be disposed between the resilient material 14" and the metal shell 92. In some embodiments, the resilient material 14" may be structured and shaped such that the resilient material 14" stays in place over the metal shell 92.

The cartridge 90 may include a mechanism for attachment to the metal core 13", such as one or more tabs 94. The tabs 94 may protrude from a surface of the metal shell 92, and, when the cartridge 90 is placed over the metal core 13", may be disposed within one or more corresponding slots 96 in the metal core 13". Thus, when the cartridge 90 is over the metal core 13", rotation of the cartridge 90 with respect to the metal core 13" may be restricted by the interference of the tabs 94 with the metal core 13".

The cartridge 90 may be removable from the metal core 13" so that the cartridge 90 may be operated in either of two opposing orientations, as previously described herein. The cartridge 90 may be configured to slide onto and off of the metal core 13" when the rotor 11" is at least partially disconnected from a drill string. For example, when the rotor 11" is separated from a stator 6 (FIG. 1A), the cartridge 90 may slide off of the metal core 13". The cartridge 90 may include pins or other fastening means to lock the cartridge 90 to the metal core 13".

A rotor 11" having a cartridge 90 need not have the same connection hardware (e.g., threads, adapters, etc.) at both ends thereof because the cartridge 90 itself can be reversed over the metal core 13". Thus, a rotor 11" having a cartridge 90 may be fitted to existing drill strings with little modification, and without adapters.

Although the present disclosure has been described in terms of hydraulic drilling motors, it is understood that similar devices may operate as hydraulic pumps by driving rotation of the drive shaft to pump hydraulic fluid through the body of the pump. Thus, embodiments of the disclosure may also apply to such hydraulic pumps, and to systems and devices including such hydraulic pumps.

Additional non-limiting example embodiments of the disclosure are described below.

Embodiment 1: A hydraulic tool, comprising a stator and a rotor rotatably disposed within the stator. At least one of at least an inner portion of the stator and at least an outer portion of the rotor is configured to be installed in a drill string in either of two inverted orientations along a longitudinal axis of the hydraulic tool. The rotor is configured to rotate within the stator in either of the two inverted orientations.

Embodiment 2: The hydraulic tool of Embodiment 1, wherein the at least one of at least an inner portion of the stator and the at least one of an outer portion of the rotor comprises a resilient material.

Embodiment 3: The hydraulic tool of Embodiment 2, wherein the resilient material comprises a material selected from the group consisting of fluorosilicone rubber, nitrile butadiene rubber, fluoroelastomers, hydrogenated nitrile butadiene rubber, fluorinated ethylene propylene, vinyl methyl polysiloxane, carboxylated nitrile butadiene rubber, polyacrylate acrylic rubber, perfluoroelastomers, ethylene propylene rubber, ethylene propylene diene monomer rubber, and acrylic ethylene copolymer.

Embodiment 4: The hydraulic tool of Embodiment 2 or Embodiment 3, wherein the at least an inner portion of the stator comprises an insert comprising the resilient material within a cartridge.

Embodiment 5: The hydraulic tool of any of Embodiments 1 through 4, wherein the at least an outer portion of the rotor comprises a cover comprising the resilient material.

Embodiment 6: The hydraulic tool of Embodiment 5, wherein the cover is configured to be disposed over the rotor in either of two inverted orientations along a longitudinal axis of the rotor.

Embodiment 7: The hydraulic tool of any of Embodiments 1 through 6, wherein at least one of the stator and the rotor comprises a first set of threads at a first end thereof and a second set of threads at a second end thereof opposite the first end. The first set of threads and the second set of threads are each configured to be secured to adapters having corresponding fittings.

Embodiment 8: The hydraulic tool of Embodiment 7, wherein the first set of threads has a pitch, thread density, and thread profile identical to a pitch, thread density, and thread profile of the second set of threads.

Embodiment 9: The hydraulic tool of Embodiment 7 or Embodiment 8, wherein the first set of threads and the second set of threads are either both male or both female.

Embodiment 10: The hydraulic tool of any of Embodiments 1 through 9, further comprising at least one adapter secured to at least one end of the stator.

Embodiment 11: The hydraulic tool of any of Embodiments 1 through 10, wherein the stator comprises an outer casing and a removable cartridge within the outer casing.

Embodiment 12: The hydraulic tool of Embodiment 11, wherein the removable cartridge comprises a metal sheath and a liner comprising a resilient material.

Embodiment 13: The hydraulic tool of Embodiment 12, wherein the metal sheath is interlocked to the outer casing.

Embodiment 14: The hydraulic tool of any of Embodiments 1 through 13, wherein at least one surface of the rotor and at least one surface of the stator together define a plurality of movable discrete sealed cavities configured to move generally longitudinally as the rotor rotates.

Embodiment 15: The hydraulic drilling motor of any of Embodiments 1 through 14, further comprising a hardfacing material disposed on at least one of an outer surface of the rotor and an inner surface of the stator.

Embodiment 16: The hydraulic drilling motor of Embodiment 15, wherein the hardfacing material comprises a material selected from the group consisting of chrome, nickel, cobalt, tungsten carbide, diamond, diamond-like-carbon, boron carbide, cubic boron nitride, nitrides, carbides, oxides, borides, and alloys hardened by nitriding, boriding, or carbonizing.

Embodiment 17: A method of using a hydraulic tool includes disposing a rotor within a cavity defined by a stator. The stator has a plurality of lobes having a first end disposed proximate an upper end of the hydraulic tool and a second end longitudinally opposite the first end disposed proximate a lower end of the hydraulic tool. The rotor has at least one lobe having a first end and a second end longitudinally opposite the first end. The first end of the at least one lobe of the rotor is disposed proximate the upper end of the hydraulic tool, and the second end of the at least one lobe of the rotor is disposed proximate the lower end of the hydraulic tool. The methods further include passing a fluid through the cavity defined by the stator to rotate the rotor and at least one of removing the rotor from the cavity defined by the stator and removing the stator from the hydraulic tool. The methods include at least one of disposing the rotor into the cavity defined by the stator such that the first end of the rotor is disposed proximate the lower end of the hydraulic tool and the second end of the rotor is disposed proximate the upper end of the hydraulic tool and securing the stator to the hydraulic tool such that the first end of the stator is proximate the lower end of the hydraulic tool and the second end of the stator is proximate the upper end of the hydraulic tool.

Embodiment 18: The method of Embodiment 17, wherein passing a fluid through the cavity defined by the stator comprises forming a plurality of movable discrete sealed cavities, the discrete sealed cavities defined by an exterior surface of the at least one lobe of the rotor and an interior surface of the plurality of lobes of the stator.

Embodiment 19: The method of Embodiment 17 or Embodiment 18, further comprising separating a cartridge comprising the plurality of lobes from an outer casing of the stator, reversing a longitudinal orientation of the cartridge with respect to the outer casing, and inserting the cartridge into the outer casing in the reversed longitudinal orientation.

Embodiment 20: The method of any of Embodiments 17 through 19, further comprising securing an adapter to at least one end of the stator.

Embodiment 21: The method of any of Embodiments 17 through 20, further comprising attaching the rotor to a drive shaft configured to rotate a drill bit.

Embodiment 22: The method of any of Embodiments 17 through 21, wherein disposing the rotor into the cavity defined by the stator such the first end of the rotor is disposed proximate the second end of the stator and the second end of the rotor is disposed proximate the first end of the stator comprises reversing a direction of the stator in a drill string.

Embodiment 23: A drilling system comprising a fluid source, a hydraulic tool, a drive shaft operatively associated with the rotor of the hydraulic tool, and a drill bit operatively associated with the drive shaft. The hydraulic tool includes a stator and a rotor rotatably disposed within the stator. At least one of at least an inner portion of the stator and at least an outer portion of the rotor is configured to be installed in a drill string in either of two inverted orientations along a longitudinal axis of the hydraulic tool. The rotor is configured to rotate within the stator in either of the two orientations of the stator when fluid is provided to the hydraulic drilling motor from the fluid source.

Embodiment 24: A progressive cavity pump, comprising a stator and a rotor rotatably disposed within the stator such that the rotor and the stator together define at least one movable fluid cavity. At least an outer portion of the rotor is configured to be installed in either of two inverted orientations along a longitudinal axis of at least an inner portion of the stator. The rotor is configured to rotate within the stator in either of the two inverted orientations.

Embodiment 25: A hydraulic drilling motor, comprising a stator and a rotor rotatably disposed within the stator. At least an inner portion of the stator is configured to be installed in a drill string in either of two inverted orientations along a longitudinal axis of the hydraulic drilling motor. The rotor is configured to rotate within the stator in either of the two orientations of the stator.

Embodiment 26: A drilling system, comprising a fluid source, a hydraulic drilling motor, a drive shaft operatively associated with the rotor of the hydraulic drilling motor, and a drill bit operatively associated with the drive shaft. The hydraulic drilling motor includes a stator and a rotor rotatably disposed within the stator. At least an inner portion of the stator is configured to be installed in a drill string in either of two inverted orientations along a longitudinal axis of the hydraulic drilling motor. The rotor is configured to rotate within the stator in either of the two orientations of the stator when fluid is provided to the hydraulic drilling motor from the fluid source.

While the present invention has been described herein with respect to certain illustrated embodiments, those of ordinary skill in the art will recognize and appreciate that it is not so limited. Rather, many additions, deletions, and modifications to the illustrated embodiments may be made without departing from the scope of the invention as hereinafter claimed, including legal equivalents thereof. In addition, features from one embodiment may be combined with features of another embodiment while still being encompassed within the scope of the invention as contemplated by the inventors. Further, embodiments of the disclosure have utility with different and various bit profiles as well as cutting element types and configurations.

What is claimed is:

1. A method of using a downhole motor, comprising:

disposing a cartridge within a housing, the cartridge having at least one lobe, the cartridge having a first end disposed closer to a first end of the downhole motor and a second end longitudinally opposite the first end disposed closer to a second end of the downhole motor;

disposing a rotor within a passage defined by the cartridge, the rotor having at least one lobe, the rotor having a first end and a second end longitudinally opposite the first end, wherein the first end of the rotor is disposed closer to the first end of the downhole motor, and wherein the second end of the rotor is disposed closer to the second end of the downhole motor;

passing a fluid through the passage defined by the cartridge to rotate the rotor;

at least one act selected from the group consisting of removing the rotor from the passage defined by the cartridge and removing the cartridge from the housing; and at least one act selected from the group consisting of:

disposing the rotor into the passage defined by the cartridge such that the first end of the rotor is disposed closer to the second end of the downhole motor and the second end of the rotor is disposed closer to the first end of the downhole motor; and securing the cartridge to the housing such that the first end of the cartridge is closer to the second end of the downhole motor and the second end of the cartridge is closer to the first end of the downhole motor.

2. The method of claim 1, further comprising:

securing the cartridge rotationally to the housing with at least one tab on at least one device selected from the group consisting of the cartridge and the housing; and interlocking the tab with at least one recess on at least one device selected from the group consisting of the cartridge and the housing.

3. The method of claim 1, wherein a first fitting on a first end of the housing has a shape substantially the same as a shape of a second fitting on a second end of the housing.

4. The method of claim 3, wherein the first fitting comprises a first set of threads and the second fitting comprises a second set of threads.

5. The method of claim 4, wherein the first set of threads has a pitch, thread density, and thread profile identical to a pitch, thread density, and thread profile of the second set of threads.

6. The method of claim 5, wherein the first set of threads and the second set of threads are either both male or both female.

7. The method of claim 1, further comprising securing a resilient material to at least one surface selected from the group consisting of an outer surface of the rotor and an inner surface of the passage defined by the cartridge.

8. The method of claim 7, further comprising removing the resilient material and re-installing the resilient material in an inverted direction after at least one use of the downhole motor.

9. The method of claim 1, further comprising attaching the rotor to a drive shaft configured to rotate a downhole tool for use in a subterranean borehole.

10. The method of claim 1, further comprising providing a first thread on the first end of the housing and providing a second thread on the second end of the housing.

11. The method of claim 10, wherein the first thread and the second thread have a same pitch, a same thread density, and a same thread profile.

* * * * *